US009084496B1

(12) United States Patent
Neelagantan et al.

(10) Patent No.: US 9,084,496 B1
(45) Date of Patent: Jul. 21, 2015

(54) REFRIGERATED DISPLAY CASE

(71) Applicant: Heatcraft Refrigeration Products LLC, Richardson, TX (US)

(72) Inventors: Chera Selvan Neelagantan, Columbus, GA (US); Surendran Ramasamy, Chennai (IN)

(73) Assignee: HEATCRAFT REFRIGERATION PRODUCTS LLC, Richardson, TX (US)

( * ) Notice: Subject to any disclaimer, the term of this patent is extended or adjusted under 35 U.S.C. 154(b) by 0 days.

(21) Appl. No.: 14/273,578

(22) Filed: May 9, 2014

(51) Int. Cl.
*A47F 3/04* (2006.01)

(52) U.S. Cl.
CPC ..... *A47F 3/0491* (2013.01)

(58) Field of Classification Search
CPC .... A47F 3/0439; A47F 3/0443; A47F 3/0408
USPC ..... 312/116, 257.1, 263, 265.5; 62/255, 62/256
See application file for complete search history.

(56) References Cited

U.S. PATENT DOCUMENTS

| | | | | |
|---|---|---|---|---|
| 6,145,327 | A * | 11/2000 | Navarro | 62/89 |
| 7,293,424 | B2 * | 11/2007 | Jaffer et al. | 62/255 |
| 7,318,321 | B2 * | 1/2008 | Grassmuck et al. | 62/255 |
| 7,819,069 | B2 * | 10/2010 | Tanaka et al. | 108/64 |
| 8,430,254 | B2 * | 4/2013 | Kunis | 211/189 |
| 2006/0107676 | A1 * | 5/2006 | Fockter | 62/246 |
| 2007/0194670 | A1 * | 8/2007 | Amari et al. | 312/116 |
| 2013/0019621 | A1 * | 1/2013 | Wood et al. | 62/126 |

* cited by examiner

*Primary Examiner* — Hanh V Tran
(74) *Attorney, Agent, or Firm* — Sutherland Asbill & Brennan LLP

(57) ABSTRACT

A refrigerated display case. The refrigerated display case may include a number of shelf standards and an inside back panel attached to the shelf standards. The inside back panel may include a number of vertically stacked inside back panel sections that are individually removable from the remaining sections.

20 Claims, 7 Drawing Sheets

REFRIGERATED DISPLAY CASE

TECHNICAL FIELD

The present application and the resultant patent relate generally to modular refrigeration systems and more particularly relate to a refrigerated display case with modular, thermoformed inside back panels for ease of installation and improved serviceability.

BACKGROUND OF THE INVENTION

The modern supermarket may have any number of refrigerated display cases to store and display different types of frozen and refrigerated products. Many different types of refrigerated display cases may be used, including multi-deck coolers, reach-in coolers, and the like. The refrigerated display cases generally are modular in nature such that any number of individual units may be combined to create a display case of any suitable length. Although many of the components of a refrigerated display case may be substantially modular in nature, the installation of such a refrigerated display case may involve a considerable amount of on-site labor to install the refrigeration components such as the associated evaporator coils, plumbing, fans, and controls as well as shelves, lighting, and the like.

There is thus a desire for an improved refrigerated display case and a method of installing the same. The refrigerated display case may include a number of modular, thermoformed inside back panels for ease of installation and improved serviceability.

SUMMARY OF THE INVENTION

The present application and the resultant patent thus provide a refrigerated display case. The refrigerated display case may include a number of shelf standards and an inside back panel attached to the shelf standards. The inside back panel may include a number of vertically arranged inside back panel sections.

The present application and the resultant patent further provide a method of assembling a refrigerated display case. The method may include the steps of positioning a first inside back panel section adjacent to a tub assembly, attaching the first inside back panel section to a pair of shelf standards via a first locking tab with a snap fit, and attaching a second inside back panel section to a top of the first inside back panel section via a mounting tab and to the pair of shelf standards via a second locking tab with the snap fit.

The present application and the resultant patent further provide an aft wall for a refrigerated display case. The aft wall may include a foam panel, an air plenum, and an inside back panel. The inside back panel may include a number of vertically arranged inside back panel sections.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
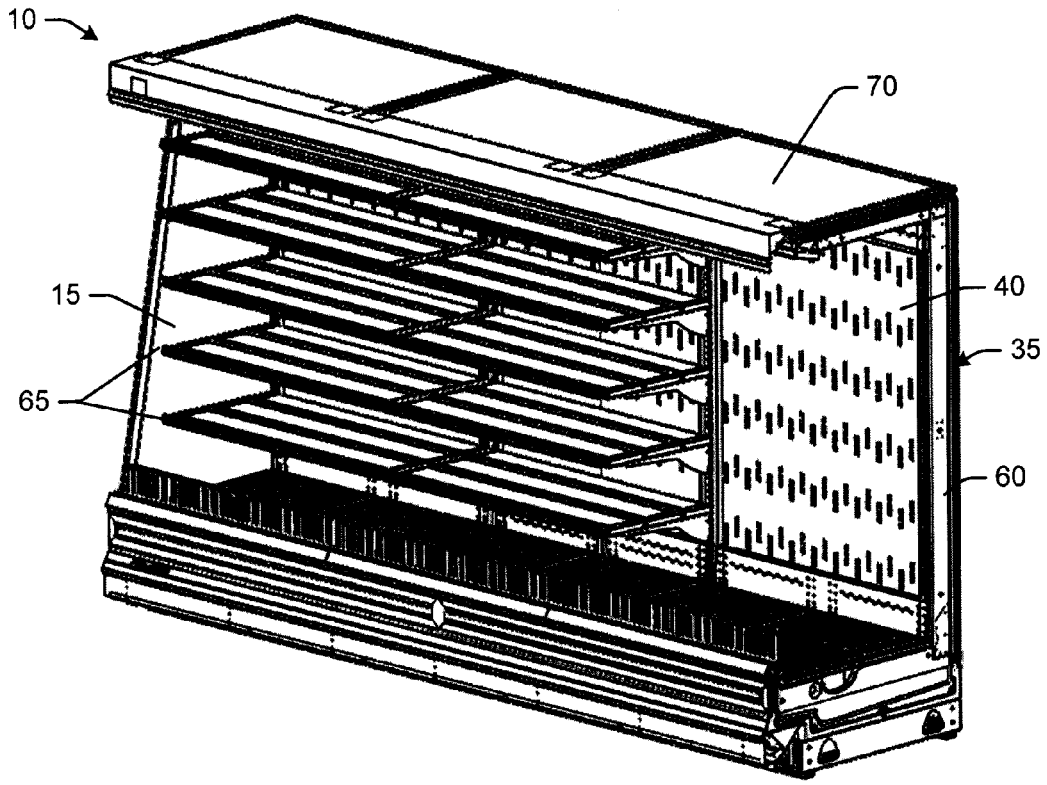
FIG. 1 is a perspective view of a known refrigerated display case in the form of a multi-deck cooler.

Referring now to the drawings, in which like numerals refer to like elements throughout the several views, FIG. 1 shows an example of a refrigerated display case 10. The refrigerated display case 10 may be a multi-deck cooler, a reach-in cooler or any type of display case generally designed for retail use. The refrigerated display case 10 may be substantially modular and may extend to any suitable length. The refrigerated display case 10 may define a refrigerated space 15. Any type or number of refrigerated or frozen products may be positioned within the refrigerated space 15. The refrigerated display case 10, and the components thereof, may have any suitable overall size, shape, or configuration.

Figure 2:
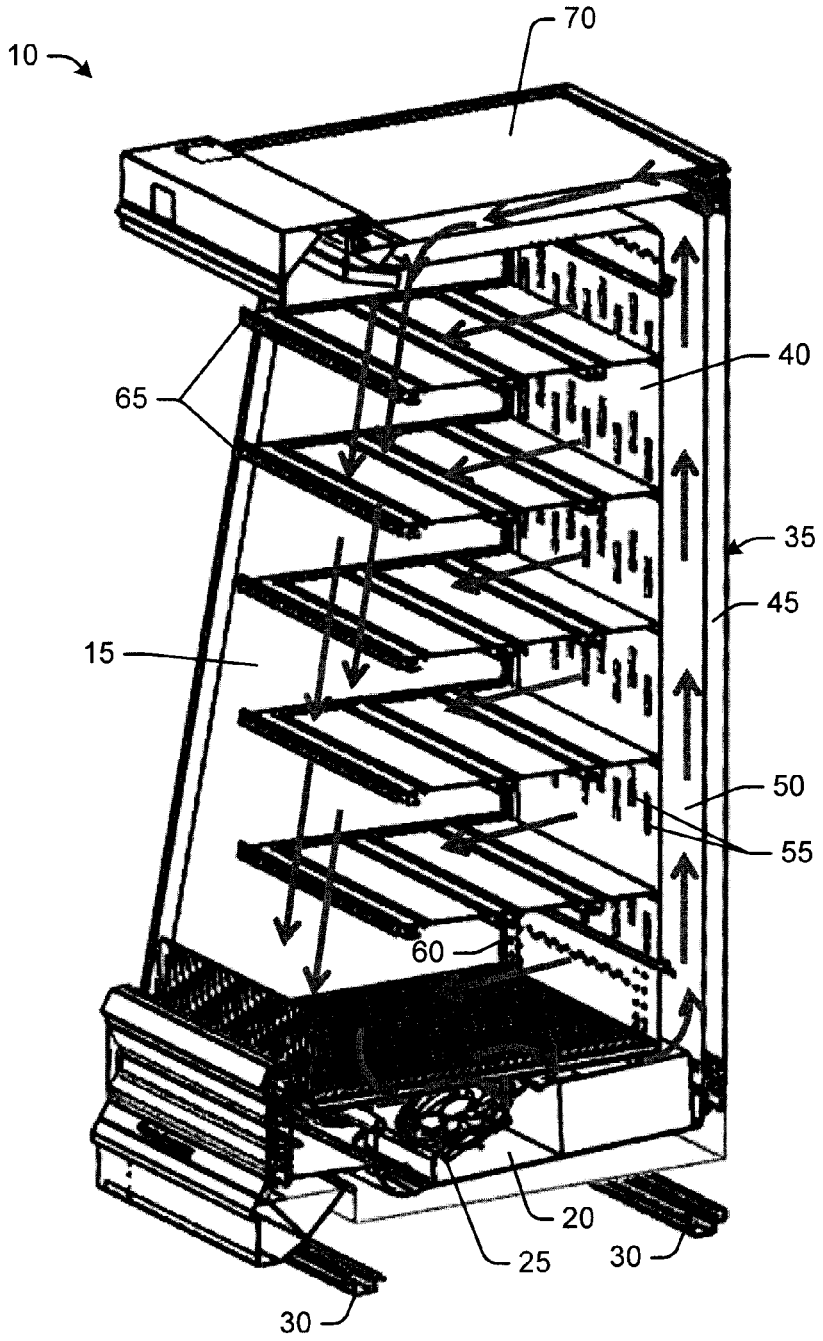
FIG. 2 is a sectional view of a portion of the refrigerated display case of FIG. 1.

As is shown in FIG. 2, the refrigerated display case 10 may include a tub assembly 20. The tub assembly 20 may include a refrigeration unit 25 therein. Any type of refrigeration unit 25 and refrigeration components may be used herein. The tub assembly 20 may be supported by a number of skid rails 30. Other types of support structures may be used herein.

An aft wall 35 may be positioned adjacent to the tub assembly 20. The aft wall 35 may include an inside back panel 40, an outer foam panel 45, and an air plenum 50 therebetween. The aft wall 35, and the components thereof, may have any suitable size, shape, or configuration. The air plenum 50 may be in communication with the refrigeration unit 25. The inside back panel 40 generally may be made from relatively thin metals and may extend for the length of the aft wall 35. The inside back panel 40 may include a number of back panel apertures 55 in communication with the air plenum 50. Refrigerated air from the refrigeration unit 25 may flow through the air plenum 55 and into the refrigerated space 15 via the back panel apertures 55. The aft wall 35, and the components thereof, may be supported by a number of shelf standards 60. The shelf standards 60 may have any suitable size, shape, or configuration. A number of shelves 65 may be positioned on the shelf standards 60 adjacent to the inside back panel 40. Any number of the shelves 65 may be used in any size, shape, or configuration. A ceiling panel 70 may be mounted on the aft wall 35. The refrigerated display case 10 and the components thereof described herein are for the purpose of example only. Many other and different display case designs and configurations may be used.

Figure 3:
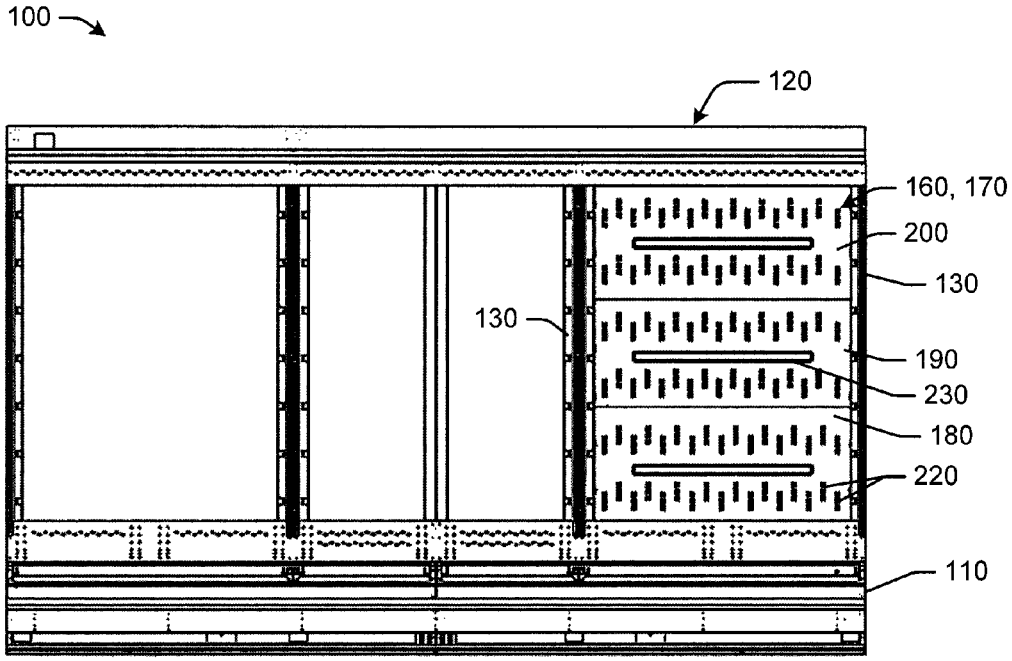
FIG. 3 is a front plan view of a refrigerated display case with an inside back panel as may be described herein.
Figure 4:
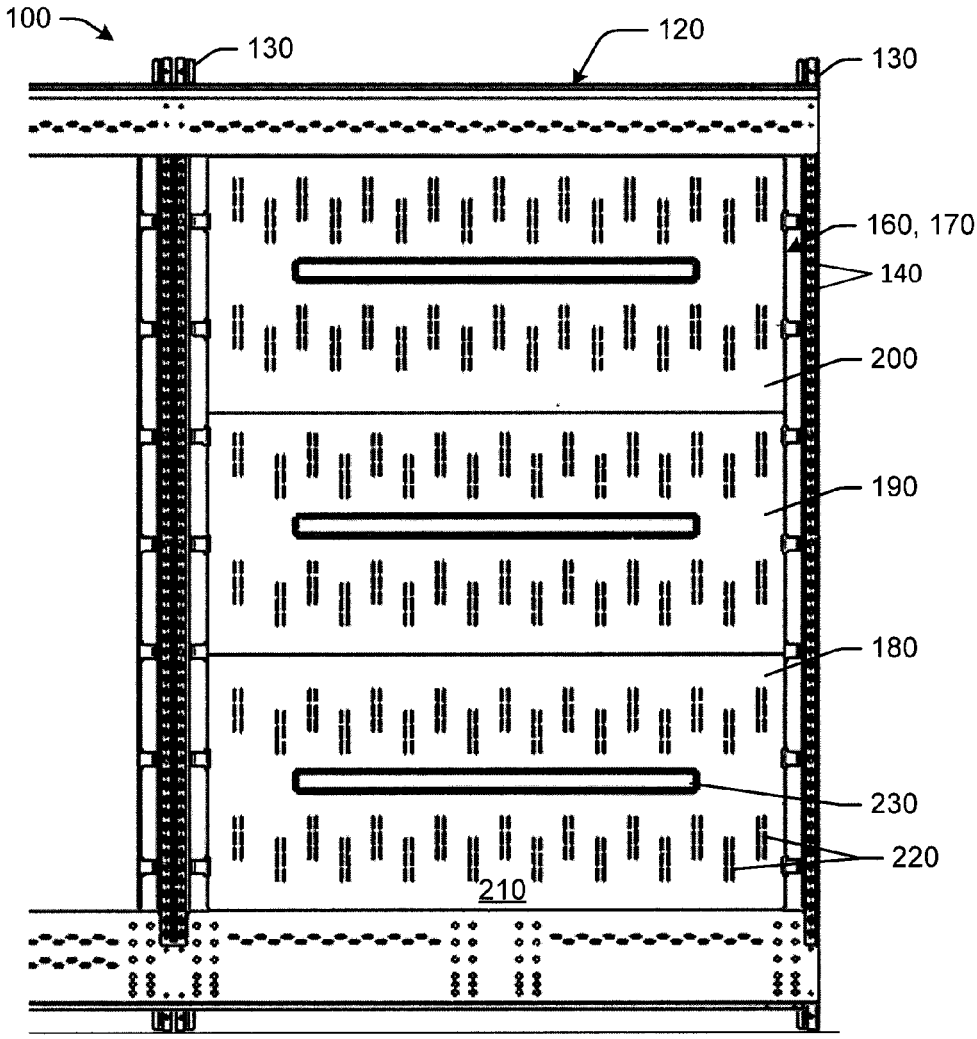
FIG. 4 is a further front plan view of a portion of the refrigerated display case of FIG. 3.

FIG. 3 shows a refrigerated display case 100 as may be described herein. The refrigerated display case 100, and the components thereof, may have may have any suitable size, shape, or configuration. Similar to that described above, the refrigerated display case 100 may include a tub assembly 110 with any type of refrigeration components therein. The refrigerated display case 100 also may include an aft wall 120 positioned adjacent to the tub assembly 110 and in communication with the refrigeration components. The aft wall 120 may be supported by a number of shelf standards 130. Any number of the shelf standards 130 may be used herein in any suitable size, shape, or configuration. The shelf standards 130 generally extend vertically from the tub assembly 110. As is shown in FIG. 4, the shelf standards may have a number of shelf apertures 140 positioned thereon. The shelf apertures 140 may allow for the installation of any number of shelves 65 thereon. The shelf standards 130 also may have a number of side apertures 150 formed therein. The side apertures 150 may have any suitable size, shape, or configuration. The side apertures 150 may be used for support as will be described in more detail below as well as for wiring, access, and for other purposes. Other components and other configurations may be used herein.

Figure 5:
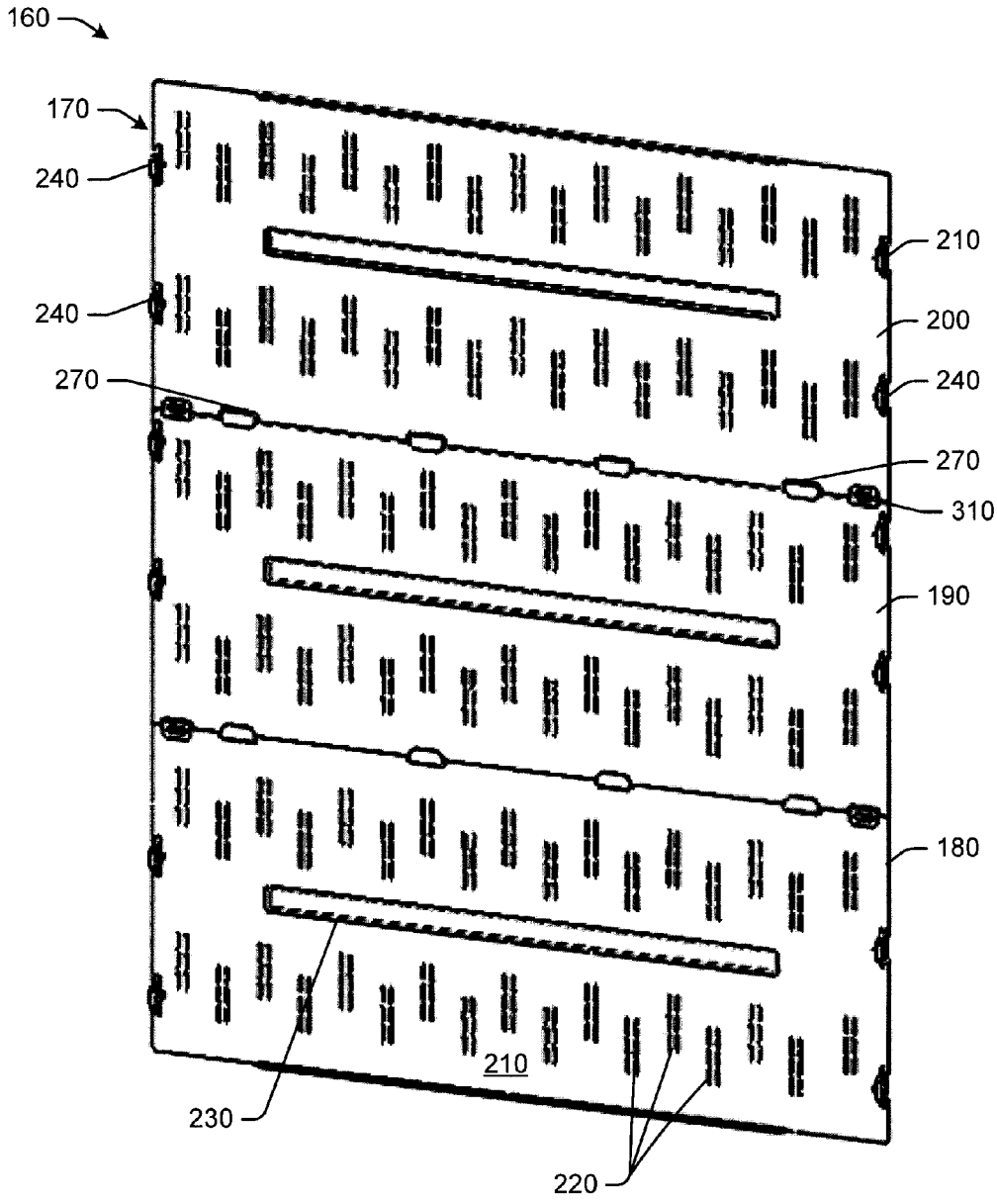
FIG. 5 is a perspective view of a number of inside back panel sections of FIG. 3.

The aft wall 120 also includes an inside back panel 160. The inside back panel 160 may be attached to the shelf standards 130 as will be described in more detail below. In this example, the inside back panel 160 may be modular and may be formed by one or more vertically arranged inside back panel sections 170. Specifically, FIGS. 4 and 5 show a bottom section 180, a middle section 190, and a top section 200. The bottom section 180 and the top section 200 may be mirror images of each other. Any number of the inside back panel sections 170 may be used may in any size, shape, or configuration. Each inside back panel section 170 may be made from a substantially rigid thermoplastic 210 in a thermoforming process. Other types of materials and other types of manufacturing techniques such as injection molding may be used herein. Each inside back panel section 170 may have a number of back panel apertures 220 formed therein. Any number of back panel apertures 220 may be used in any size, shape, or configuration. Each inside back panel section 170 also may have one or more support ribs 230 formed therein. Other components and other configurations may be used herein.

Figure 6:
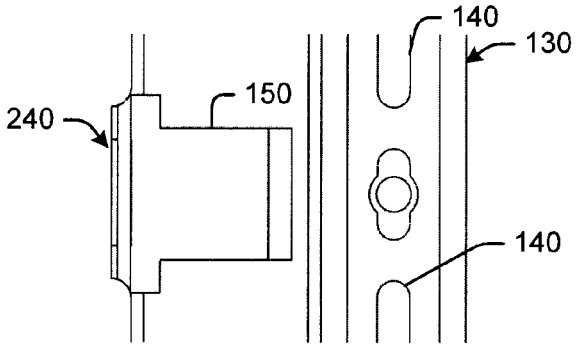
FIG. 6 is a front plan view of a locking tab of the inside back panels of FIG. 3 attached to a shelf standard.
Figure 7:
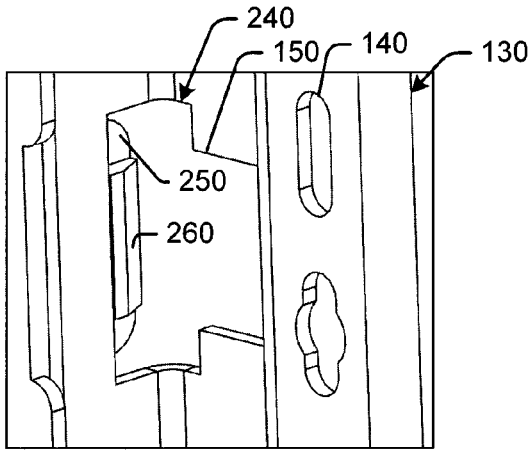
FIG. 7 is a back perspective view of the locking tab of FIG. 6 attached to the shelf standard.
Figure 8:
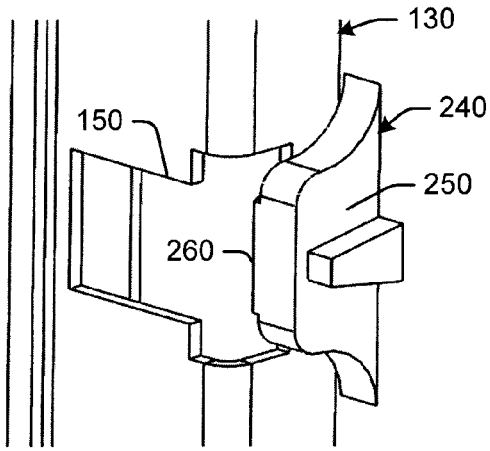
FIG. 8 is a front perspective view of the locking tab of FIG. 6 attached to the shelf standard.

As is shown in FIGS. 6-8, each inside back panel section 170 may include a number of locking tabs 240 extending from the lateral edges thereof for locking the sections 170 to the shelf standards 130. Any number of the locking tabs 240 may be used herein. The locking tabs 240 may have any suitable size, shape, or configuration. In this example, each locking tab 240 may have an extension 250 leading to a substantially perpendicular locking flange 260. The extension 250 and the locking flange 260 may be sized to accommodate the side apertures 150 of the shelf standards 130 so as to provide a releasable snap fit therein. Other types of locking structures may be used herein. Other components and other configurations may be used herein.

Figure 9:
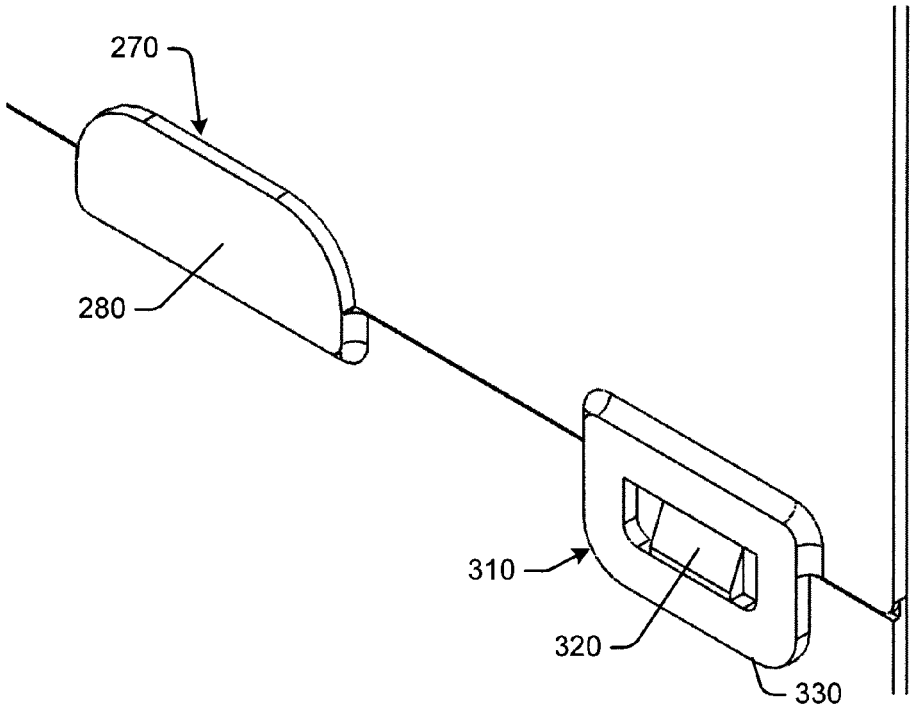
FIG. 9 is a top plan view of a mounting tab used to connect the inside back panels of FIG. 3.
Figure 10:
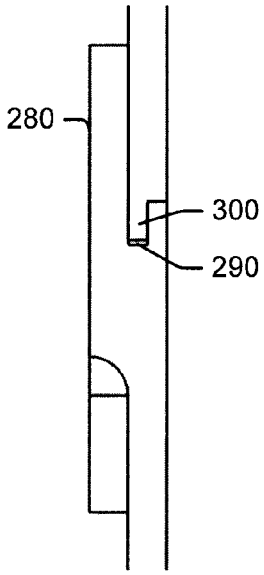
FIG. 10 is a side plan view of the mounting tab of FIG. 9.

Some or all of the back panel sections 170 also may include a number of mounting tabs 270 positioned about the vertical edges thereof for vertically mounting the sections 170 on top of each other. Any number of the mounting tabs 270 may be used herein. The mounting tabs 270 may have any suitable size, shape, or configuration. Specifically, the bottom section 180 and the top section 200 may include one or more of the mounting flanges 270 thereon so as to mate with the middle section 190 or otherwise. As is shown in FIGS. 9 and 10, each mounting tab 270 may define a mounting extension 280 that extends beyond the vertical edges of the sections 180, 190 and may define a female member 290 that may mate with a male member 300 of the middle section 190 in a snap fit manner. The respective members 290, 300 may be reversed or otherwise configured. The mounting tabs 270 also may include a number of side mounting tabs 310 on the lateral edges thereof. The side mounting tabs 310 may include a snap fit tab 320 for mating with a side mounting extension 330. The snap fit tab 320 and the mounting extension 330 may be mounted on either the middle section 190 or the bottom section 180 and the top section 200. The side mounting tabs 310 may have any suitable size, shape, or configuration. Other types of mounting structures may be used herein. Other components and other configurations may be used herein.

In use, the bottom section 180 of the inside back panel 160 may be attached to the shelf standards 130 via the locking tabs 240. The middle section 190 then may be attached via the locking tabs 240 and the mounting tabs 270. Finally, the top section 200 may be attached via the locking tabs 240 and the mounting tabs 270. Additional inside back panel sections 170 may be used herein. The back panel sections 170 may be attached to the shelf standards 130 and to each other in a substantial snap fit. Any or all of the inside back panel sections 170 may be removed from the shelf standards 130 by flexing the locking flange 260 and the extension 250 of the locking tabs 240. Likewise, raising or lowering one of the inside back panels 170 will allow it to be separated from the adjacent panel 170 via the mating tabs 270. Other components and other configurations also may be used herein.

The inside back panel sections 170 of the inside back panel 160 thus may replace the existing metal panels. Because the inside back panel sections 170 are modular, many different sizes and shapes of the refrigerated display case 100 may be accommodated herein. Moreover, the thermoformed modular design allows for high volume and high cost savings. Further, the thermoform part is significantly lighter in weight and thus may reduce the overall weight of the refrigerated display case 100. Because of the locking tabs 240 and the mounting tabs 270, the inside back panel sections 170 may be easily removed for better serviceability. Specifically, all of the shelves no longer need to be removed for faster and easier maintenance. The inside back panel sections 170 also may be ergonomically safe to install and remove.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A refrigerated display case, comprising:

a plurality of shelf standards; and an inside back panel attached to the plurality of shelf standards;

the inside back panel comprising a plurality of vertically stacked inside back panel sections;

wherein each of the plurality of vertically stacked inside back panel sections is individually removable from the remaining plurality of vertically stacked inside back panel sections.

2. The refrigerated display case of claim 1, wherein the plurality of vertically stacked inside back panel sections comprises a bottom section, a middle section, and a top section.

3. The refrigerated display case of claim 1, wherein the plurality of vertically stacked inside back panel sections comprises a thermoplastic material.

4. The refrigerated display case of claim 1, wherein the plurality of vertically stacked inside back panel sections comprises a thermoformed material.

5. The refrigerated display case of claim 1, wherein the plurality of vertically stacked inside back panel sections comprises a plurality of back panel apertures therein.

6. The refrigerated display case of claim 1, wherein the plurality of vertically stacked inside back panel sections comprises one or more support ribs therein.

7. The refrigerated display case of claim 1, wherein the plurality of vertically stacked inside back panel sections comprises a plurality of locking tabs thereon.

8. The refrigerated display case of claim 7, wherein the plurality of shelf standards comprises a plurality of shelf standard apertures and wherein the plurality of locking tabs are sized for a snap fit within the plurality of shelf standard apertures.

9. The refrigerated display case of claim 7, wherein the plurality of locking tabs comprises an extension and locking flange.

10. The refrigerated display case of claim 1, wherein the plurality of vertically stacked inside back panel sections comprises a plurality of mounting tabs.

11. The refrigerated display case of claim 10, wherein the plurality of vertically stacked inside back panel sections comprises a mounting extension defining a male or a female member.

12. The refrigerated display case of claim 10, wherein a bottom section and a top section of the plurality of vertically stacked inside back panel sections comprise the plurality of mounting tabs.

13. The refrigerated display case of claim 10, wherein the plurality of mounting tabs comprises a side mounting tab.

14. The refrigerated display case of claim 1, further comprising an aft wall and wherein the aft wall comprises a foam panel, an air plenum, and the inside back panel.

15. A method of assembling a refrigerated display case, comprising:

positioning a first inside back panel section adjacent to a tub assembly;

attaching the first inside back panel section to a pair of shelf standards via a first locking tab with a snap fit; and attaching a second inside back panel section to a top of the first inside back panel section via a mounting tab and to the pair of shelf standards via a second locking tab with a snap fit.

16. An aft wall for a refrigerated display case, comprising:

a foam panel;

an air plenum; and an inside back panel;

the inside back panel comprising a plurality of vertically stacked inside back panel sections;

wherein each of the plurality of vertically stacked inside back panel sections is individually removable from the remaining plurality of vertically stack inside back panel sections.

17. The aft wall of claim 16, wherein the plurality of vertically stacked inside back panel sections comprises a bottom section, a middle section, and a top section.

18. The aft wall of claim 16, wherein the plurality of vertically stacked inside back panel sections comprises a thermoplastic material.

19. The aft wall of claim 16, wherein the plurality of vertically stacked inside back panel sections comprises a plurality of locking tabs thereon.

20. The aft wall of claim 16, wherein the plurality of vertically stacked inside back panel sections comprises a plurality of mounting tabs.

* * * * *